US007628631B2

(12) United States Patent
Breen, IV

(10) Patent No.: US 7,628,631 B2
(45) Date of Patent: Dec. 8, 2009

(54) IN-LINE ELECTRICAL DISCONNECT WITH TERMINAL HOLDERS

(75) Inventor: Dennis M. Breen, IV, West Chicago, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 12/167,316

(22) Filed: Jul. 3, 2008

(65) Prior Publication Data

US 2009/0017691 A1 Jan. 15, 2009

Related U.S. Application Data

(60) Provisional application No. 60/948,569, filed on Jul. 9, 2007.

(51) Int. Cl.
*H01R 25/00* (2006.01)
*H01R 13/28* (2006.01)

(52) U.S. Cl. ..... 439/295; 439/858

(58) Field of Classification Search ..... 439/658, 439/660, 819, 682, 295, 849, 858
See application file for complete search history.

(56) References Cited

U.S. PATENT DOCUMENTS

| | | | | |
|---|---|---|---|---|
| 3,659,243 | A * | 4/1972 | Gluntz | 439/525 |
| 3,781,760 | A | 12/1973 | Mancini et al. | |
| 3,971,613 | A | 7/1976 | Kobler | |
| 3,976,348 | A | 8/1976 | Simmons | |
| 4,013,331 | A | 3/1977 | Kobler | |
| 4,118,093 | A * | 10/1978 | Obeissart | 439/263 |
| 4,295,698 | A | 10/1981 | Chow | |
| 4,564,259 | A | 1/1986 | Vandame | |
| 4,934,966 | A | 6/1990 | D'Urso | |
| 5,865,654 | A | 2/1999 | Shimirak et al. | |
| 6,945,830 | B2 | 9/2005 | Copper et al. | |
| 7,229,329 | B2 | 6/2007 | Yamashita et al. | |
| 7,252,562 | B1 | 8/2007 | Chen et al. | |
| 2007/0149050 | A1 | 6/2007 | Oka et al. | |
| 2008/0311802 | A1 * | 12/2008 | Keswani et al. | 439/863 |

* cited by examiner

*Primary Examiner*—Javaid Nasri
(74) *Attorney, Agent, or Firm*—Cook Alex Ltd.

(57) ABSTRACT

An electrical disconnect has a pair of selectably engageable enclosures each including one or more terminals supported therein. Each terminal has a blade at a forward end thereof. The blades are releasably engageable in overlapping relation in an engagement zone. A terminal holder biases the overlapping blades into contact with one another.

20 Claims, 22 Drawing Sheets

IN-LINE ELECTRICAL DISCONNECT WITH TERMINAL HOLDERS

CROSS-REFERENCE TO RELATED APPLICATION

This application claims the benefit of U.S. Provisional Application No. 60/948,569, filed Jul. 9, 2007, the disclosure of which is hereby incorporated herein by reference.

BACKGROUND OF THE INVENTION

This invention concerns a disconnect for electrical circuits. A disconnect normally incorporates a plug and socket combination, each connected to one or more wires. The plug and socket are releasably connectable to one another to provide a selectable connection between the sets of wires. A disconnect is often used where it is desired to have a convenient and safe way to replace circuit devices in electrical circuits. Rather than having the devices hard wired directly to the circuit, a disconnect placed between the device and a power source allows convenient interruption of power to the device for maintenance or replacement purposes.

Some prior push-in disconnects are intended for low current applications and thus are rated for current no more than about 6 amps. Other disconnects have connectors for securing incoming wires that are less than convenient to use because they typically require crimp connections to the wires. These connectors often result in bulky housings that waste space and material. Other disconnects arrange their contacts in a manner that is not optimized in terms of saving material and space.

SUMMARY OF THE INVENTION

The present invention is an electrical disconnect having push-in connections. The disconnect can be used in any electrical circuit live or dead, where quick, convenient and replaceable connections to the circuit are desirable. The push-in connections are arranged to place the ends of electrically connected wires in alignment with and closely adjacent to one another to provide a compact structure.

The disconnect has two enclosures each formed by a housing and a cap. The housings are arranged to be releasably engageable with one another along a longitudinal axis. Male and female terminals are mounted in the enclosures. The male terminal has a busbar with a contact portion connected to a male blade which extends forwardly from the contact portion. The female contact has a similar busbar with a contact portion and a female blade at its forward end. When the enclosures are connected the blades overlap and engage one another, with the extent of the overlap defining an engagement zone. The contact portions of both the male and female busbars have springs fixed thereto. The springs include flexible spring fingers adjacent an inserted conductor or wire. The spring fingers press the conductor into engagement with the associated contact portion. The enclosure housings are arranged to align mating wires or conductors with their ends closely adjacent one another so as to minimize the length and overall size of the disconnect. The ends of the mating wires are close enough together that they are within the engagement zone of the terminals' blades.

The size of the enclosures in a direction transverse to the longitudinal axis is minimized by arranging the terminals in a generally radial arrangement. Specifically, the terminal blades are mounted such that they are arcuately spaced substantially 120° from one another in a plane transverse to the longitudinal axis. The inner edges of the terminals are close enough to the longitudinal axis to minimize the outer diameter of the enclosures while still providing space for housing extensions to enclose each blade.

A terminal holder surrounds one of the blades and forms a socket for removably receiving the other blade. The terminal holder has a pressure plate which engages one of the blades and biases it into solid electrical engagement with the other blade when the enclosures are joined. The terminal holder and springs are made of a resilient material that is chosen for its mechanical properties, as they are not intended to play a significant role in conducting electricity. The busbars are made of a material chosen for its conductivity, as they are not intended to play a significant role in maintaining the mechanical integrity of the connections within the disconnect. This enables the disconnect to handle relatively high current, on the order of 20 amps.

DETAILED DESCRIPTION OF THE INVENTION

Figure 1:
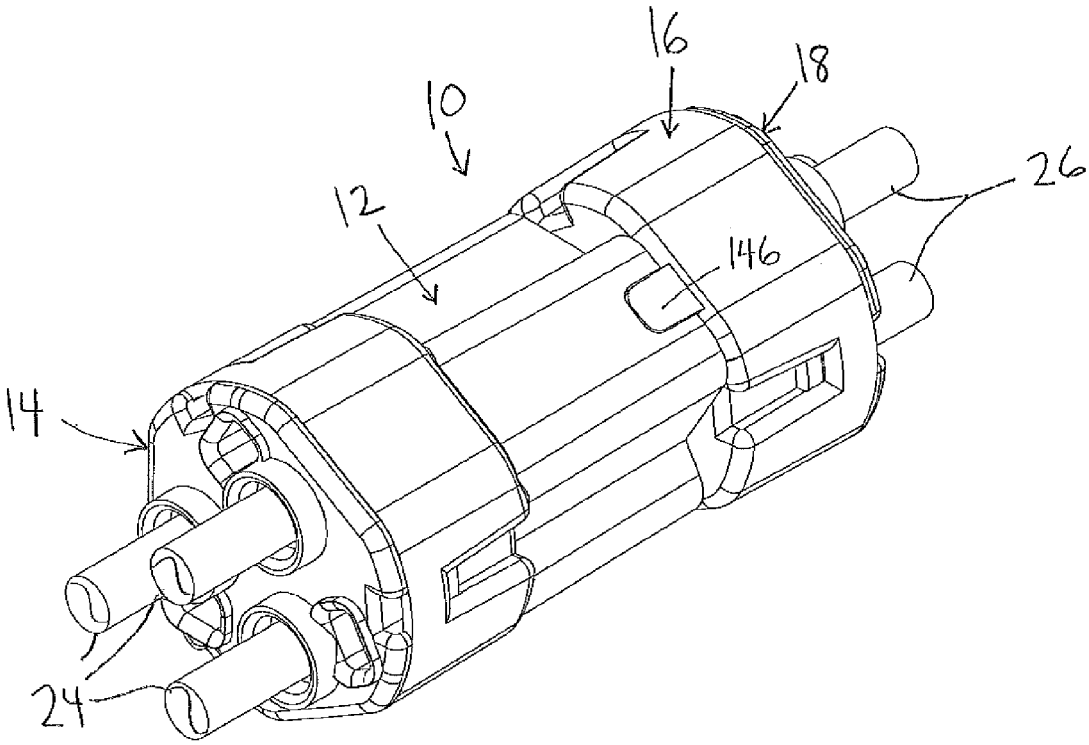
FIG. 1 is an isometric view of the assembled electrical disconnect of the present invention, with three sets of wires connected thereto.
Figure 2:
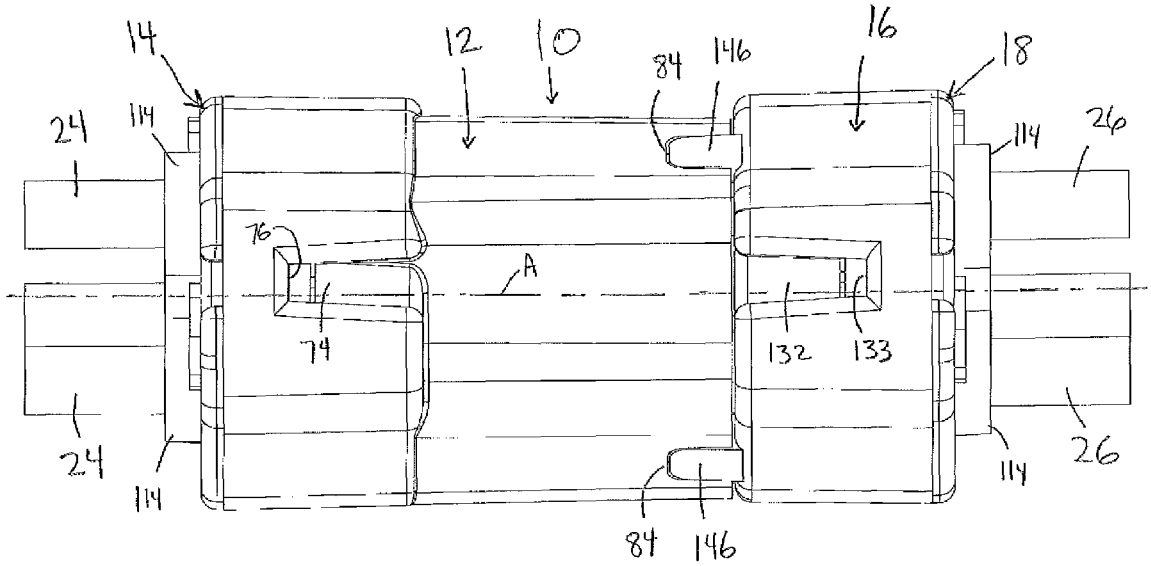
FIG. 2 is a side elevation view of the assembled electrical disconnect of the present invention.
Figure 5:
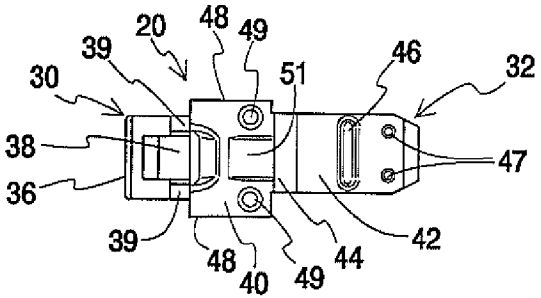
FIG. 5 is top plan view of the male terminal.
Figure 3:
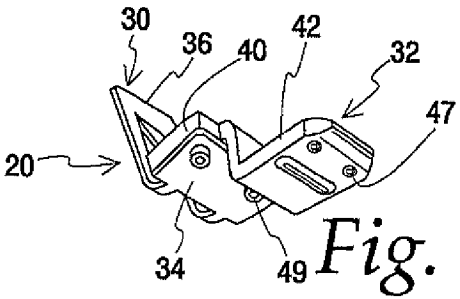
FIG. 3 is a perspective view of the male terminal.
Figure 11:
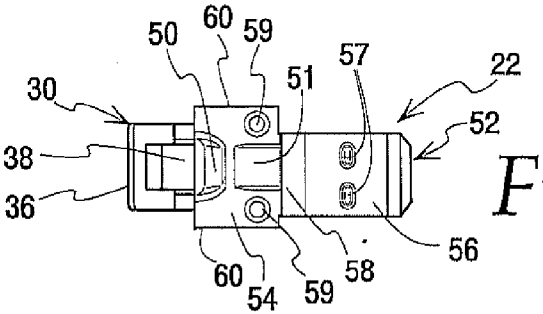
FIG. 11 is a top plan view of the female terminal.
Figure 10:
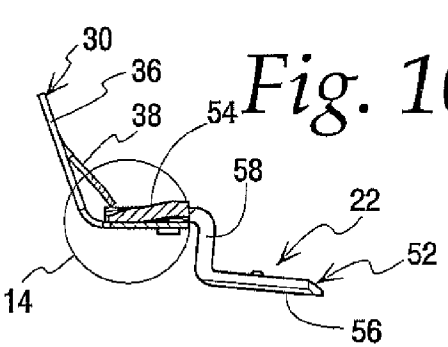
FIG. 10 is a side elevation view of the female terminal.
Figure 9:
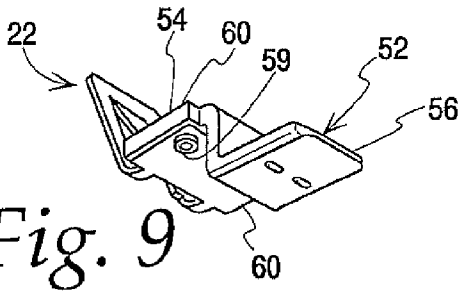
FIG. 9 is a perspective view of the female terminal.
Figure 12:
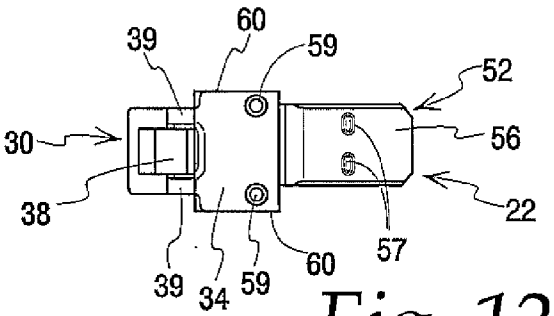
FIG. 12 is a bottom plan view of the female terminal.
Figure 13:
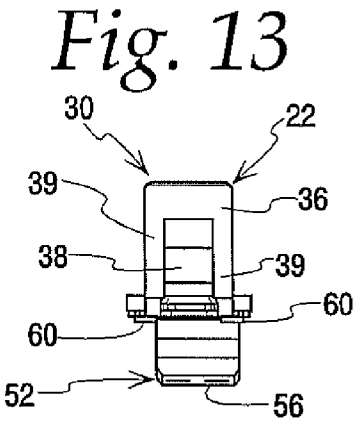
FIG. 13 is an end elevation view of the female terminal.

FIGS. 1 and 2 illustrate the assembled electrical disconnect of the present invention generally at 10. The complete disconnect includes two enclosures. A first enclosure includes a male housing 12 and a male cap 14. A second enclosure includes a female housing 16 and a female cap 18. All of these parts are made of a suitable, non-conductive material. Each of the housings has a rear shell and a forward extension. The shell has a rear side that is open to a hollow interior. The caps 14, 18 each have skirt portions which fit into and are retained in the shell. The caps also each have a transverse end wall which closes the otherwise open rear ends of the housings, except at wire entry ports and test probe openings. In the present embodiment the first enclosure has mounted therein three male electrical terminals 20 (FIG. 3) and the second enclosure has mounted in it three female electrical terminals 22 (FIG. 9). In certain embodiments of the present invention different numbers of terminals could be used or there could be more than one wire entry port per terminal. It will be understood that the designations of the housings as male and female refer to the type of terminals mounted therein, and not to the relationship of the housings to one another. Also, for reference purposes herein, the rear of a housing or cap will be considered that part which is closest to the point where the wires are inserted, while the front of a housing or cap will be considered that part which is closest to the other housing when the two housings are connected. The enclosures define a longitudinal axis A (FIG. 2) of the disconnect.

Figure 15:
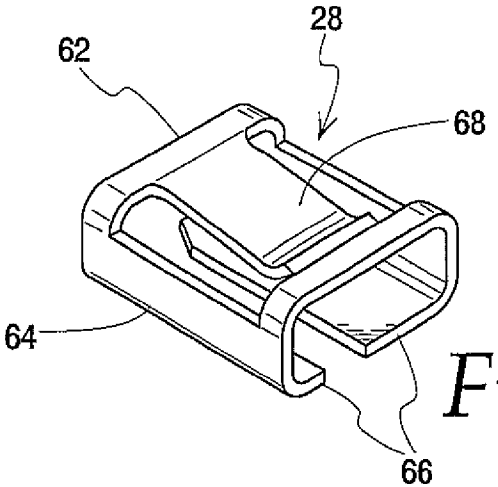
FIG. 15 is a perspective view of the terminal holder.
Figure 19:
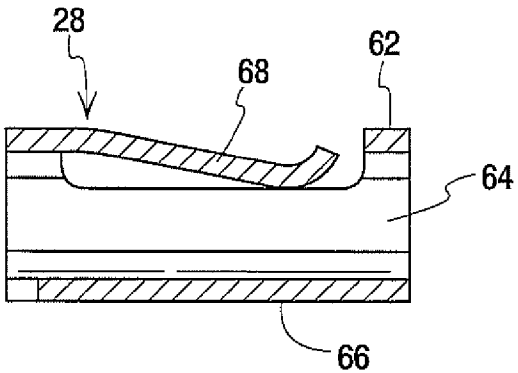
FIG. 19 is a section taken along line 19-19 of FIG. 17, on an enlarged scale.
Figure 16:
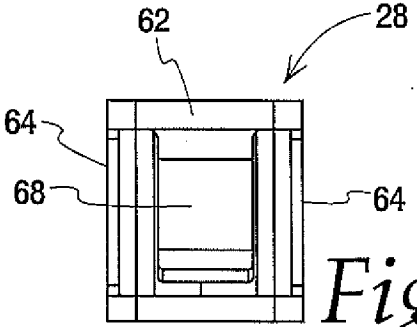
FIG. 16 is a top plan view of the terminal holder.
Figure 17:
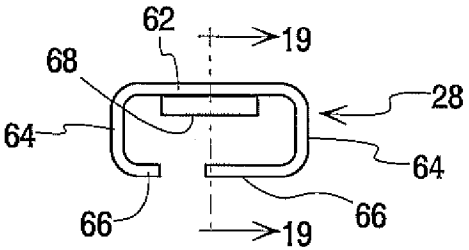
FIG. 17 is an end elevation view of the terminal holder.
Figure 18:
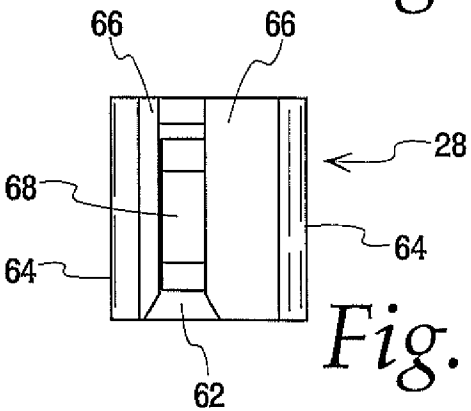
FIG. 18 is a bottom plan view of the terminal holder.

Electrical wires 24 mechanically and electrically connect to the male terminals 20 while wires 26 similarly connect to the female terminals 22, all with push-in connections as will be described later. That is, bare conductors at the ends of the wires are pushed into and through ports in the caps 14, 18 and engage the spring finger and busbar of a terminal. The front ends of the housings 12, 16 can be releasably plugged into one another to electrically connect the terminals by means of a side-by-side engagement of the male blade with the female blade. A terminal holder 28 (FIG. 15) engages the blades and clamps them together to assure solid electrical contact as will be explained in greater detail below.

Figure 4:
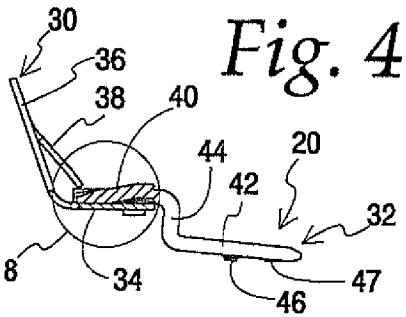
FIG. 4 is a side elevation view of the male terminal.
Figure 8:
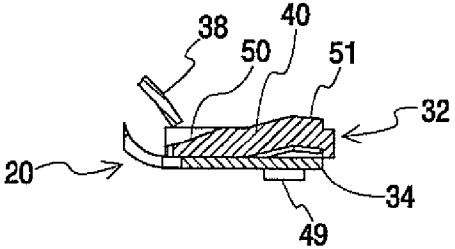
FIG. 8 is an enlarged detail view of the portion of the male terminal encircled in FIG. 4.
Figure 6:
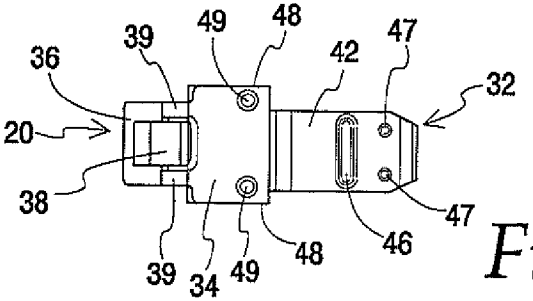
FIG. 6 is a bottom plan view of the male terminal.
Figure 7:
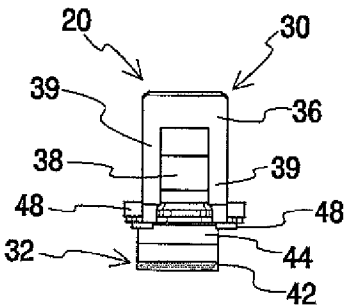
FIG. 7 is an end elevation view of the male terminal.

Details of the above components will now be described. The drawings of the housings and caps include a showing of one of the male and female terminals and the terminal holder. Accordingly, understanding of these drawings will be enhanced by first describing the terminals and holder. Male terminal 20 in FIGS. 3-8 will be described first. Terminal 20 is an assembly of two parts, namely a spring 30 and a male busbar 32. While a two-part terminal is shown, the terminal could be made from different numbers of parts. For example, instead of being a single part, the spring could be made of multiple parts. The spring has a foot 34 and an upstanding leg 36. The leg has a U-shaped slit in it which defines an opening in the leg and a spring finger 38. Tangs 39 on either side of the finger connect the leg 36 to the foot 34. The spring finger 38 is bent slightly so that it extends out of the plane of the rest of the leg, as best seen in FIG. 4. The spring finger resiliently exerts a force on an inserted wire extending through the opening in the leg. The spring is made of stainless steel so that the exerted force is strong enough to assure solid contact between the conductor and the busbar. The male busbar 32 has a contact portion 40 and a male blade 42 which are joined at a fulcrum 44. A slight protrusion 46 extends across the male blade. Two smaller bumps 47 are formed toward the distal end of the blade. The contact portion is slightly wider than the blade to form wings 48. The foot 34 matches the width of the contact portion and these two components are fastened together. In the illustrated embodiment the foot and contact portion are riveted together at 49 but it will be understood that other joining methods could be used. FIG. 8 illustrates the contact portion has a slight depression 50 near the spring finger 38 and an embossment 51 near the fulcrum 44. The purpose of this is set forth in U.S. patent application Ser. No. 11/763,096, filed Jun. 14, 2007, the disclosure of which is hereby incorporated by reference.

Figure 14:
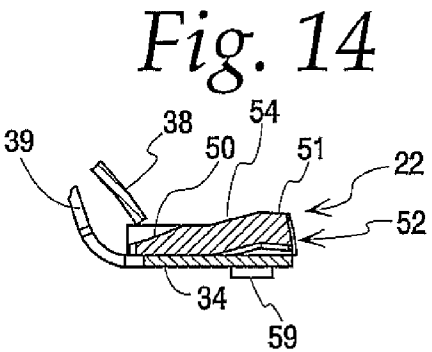
FIG. 14 is an enlarged detail view of the portion of the female terminal encircled in FIG. 10.

The female terminal 22 is shown in FIGS. 9-14. It is similar to male terminal 20 in that it is an assembly of two parts, a spring 30 and a female busbar 52. While the female busbar as illustrated differs somewhat from the male busbar, it will be understood that the male and female terminal could be identical. The spring for the female terminal can be identical to that used in the male terminal. The female busbar 52 has a contact portion 54 and a female blade 56 joined at a fulcrum 58. Two slight bumps 57 protrude from the surface of the female blade. Wings 60 are formed at the edges of the contact portion 54. The spring's foot 34 matches the width of the contact portion 54 and these two components are riveted together at 59. FIG. 14 illustrates the contact portion 54 has a slight depression 50 near the spring finger and an embossment 51 near the fulcrum 58.

FIGS. 15-19 illustrate the terminal holder 28. The terminal holder forms a channel or socket for receiving the terminal blades. The holder is a unitary steel sheet folded into a generally rectangular channel having a top wall 62, side walls 64 and bottom flanges 66. The flanges may be spaced from one another to provide some flexibility to the holder. A resilient pressure plate 68 is formed in the top wall 62. As evident in FIGS. 17 and 19, the pressure plate 68 extends into the channel formed by the holder. The purpose of the pressure plate is to urge the terminal blades receivable therein into solid electrical engagement with one another so they are capable of conducting relatively high current, on the order of 20 amps. The channel structure of the terminal holder is preferred because it positively locates both terminal blades in side-by-side relation, restrains one of the blades (in this instance the female blade) and presses the other blade into engagement with the one blade. However, other arrangements of the terminal holder are possible, including one wherein the terminal holder engages only one blade and presses it against the other one which is held against the biasing force by the housing. The terminal holder is made of material different from that of the blades because the conductive materials used for the blades do not have the desired mechanical properties required of the terminal holder.

Turning now to the description of the disconnect's enclosures, the male housing 12 is illustrated in FIGS. 20-23. The housing 12 has a generally tubular shell 70 including three flat outer walls 70A joined by three curved walls 70B. It will be understood that this roughly three-sided shape is chosen to accommodate three terminals. Other shapes could be used, particularly if different numbers of terminals are disposed in the housing. A transverse cross wall 72 completes the shell.

Figure 21:
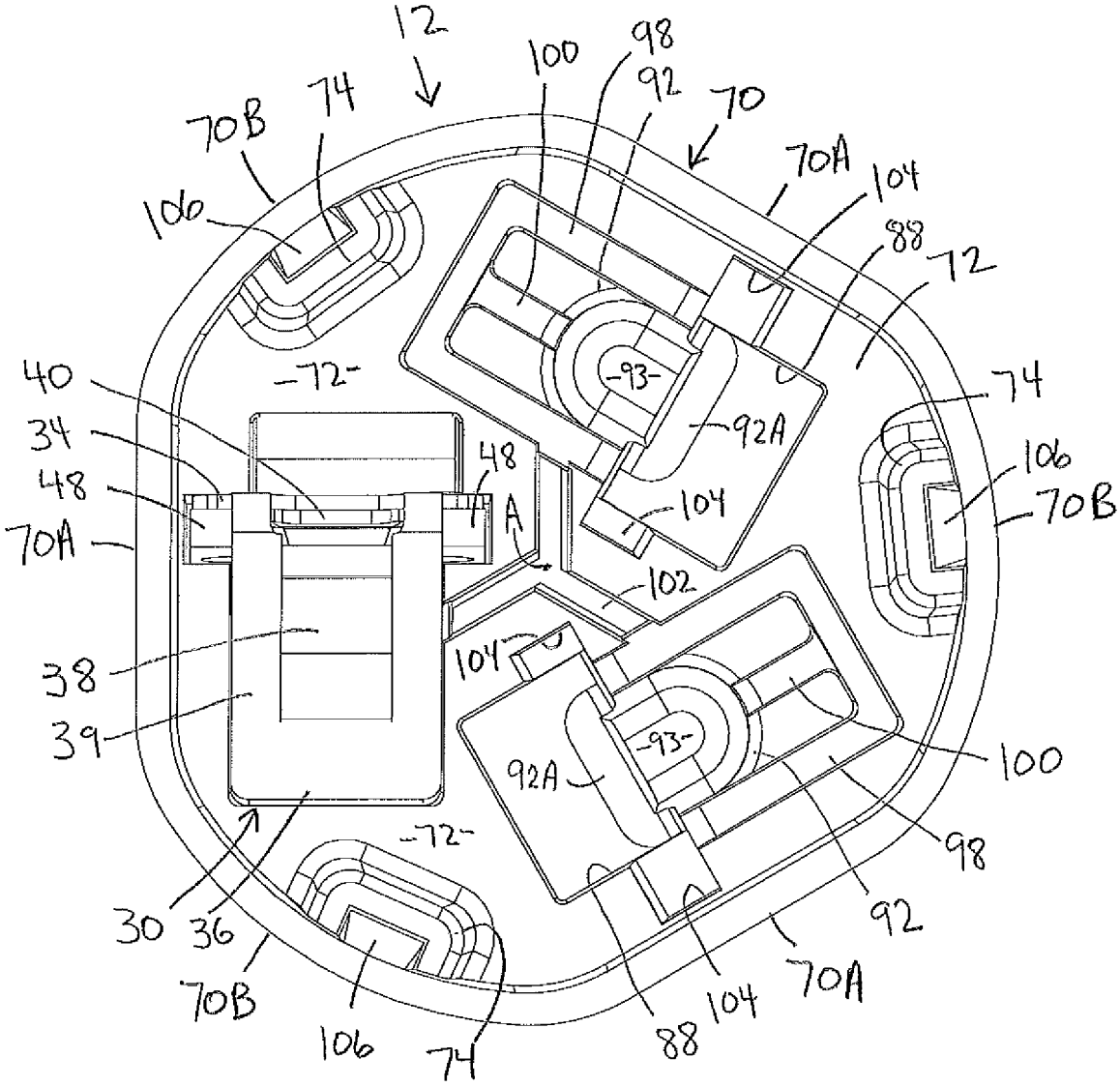
FIG. 21 is a rear elevation view of the male housing, with one male terminal shown therein.
Figure 22:
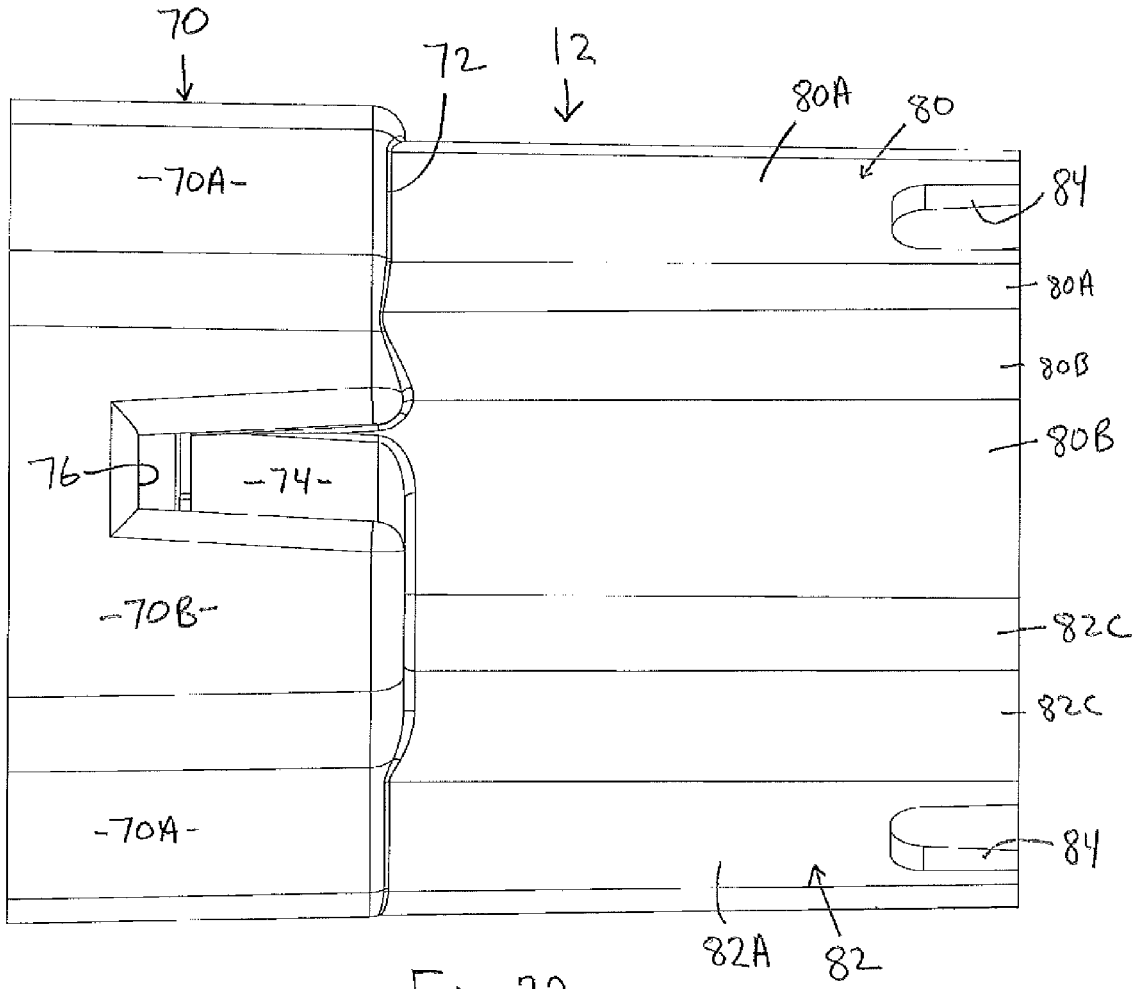
FIG. 22 is a side elevation view of the male housing.
Figure 23:
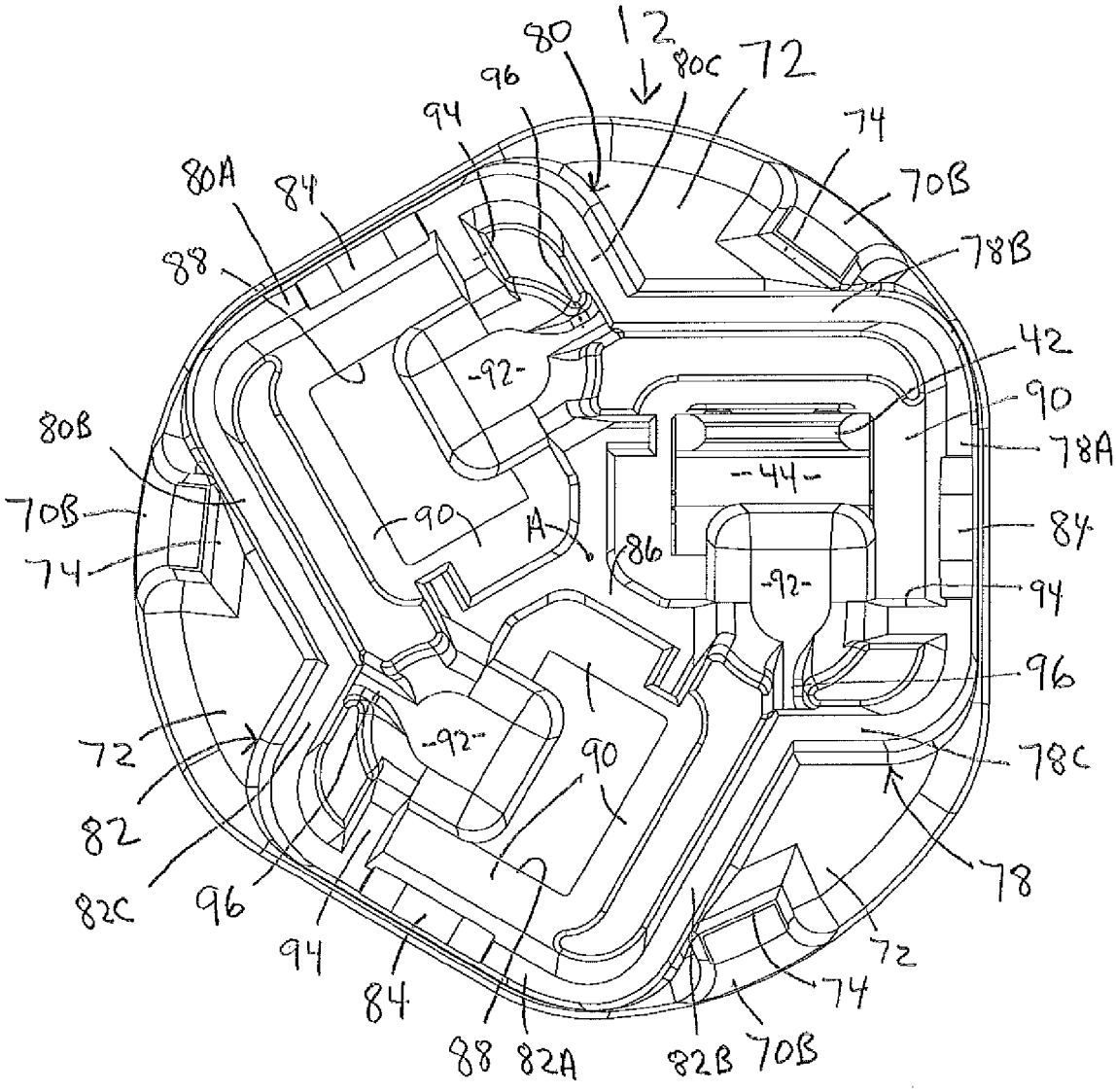
FIG. 23 is a front elevation view of the male housing, with one male terminal shown therein.
Figure 24:
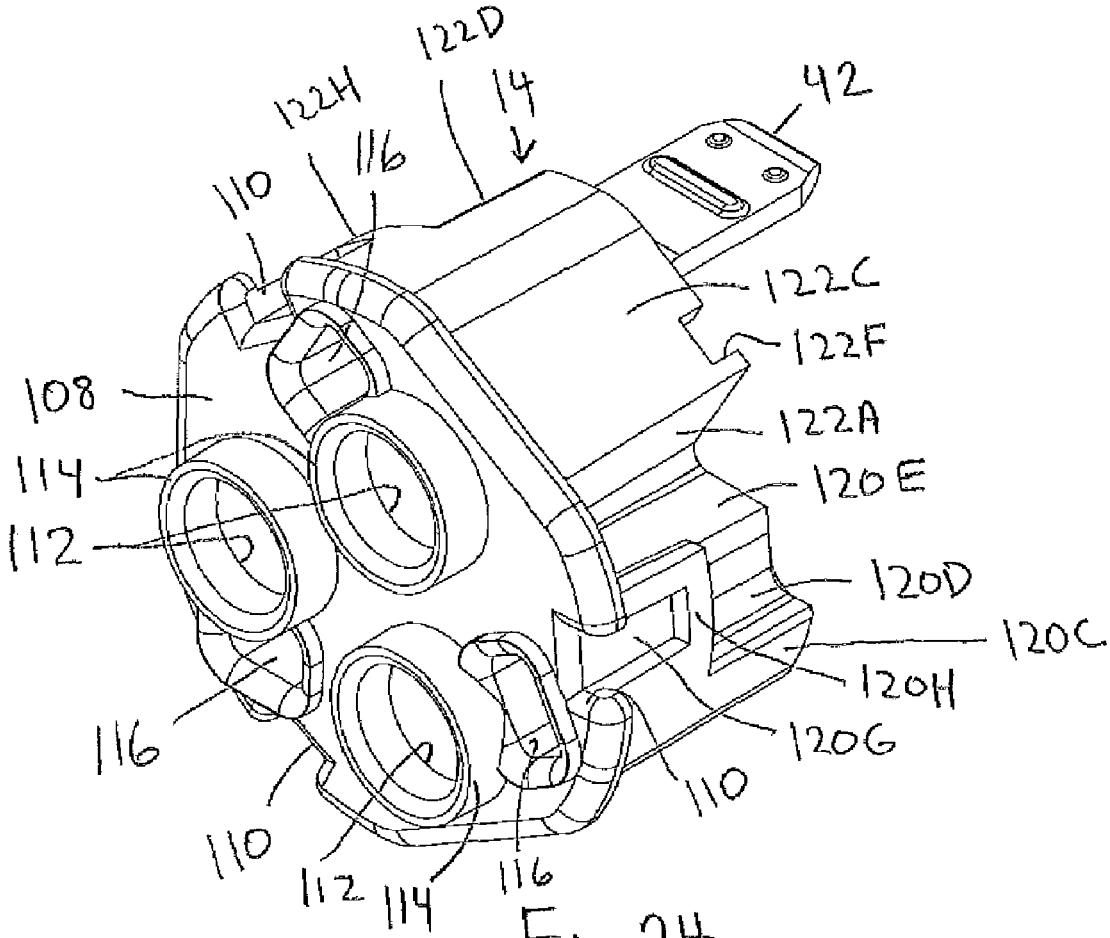
FIG. 24 is an isometric view of the male cap, with one male terminal shown therein.
Figure 25:
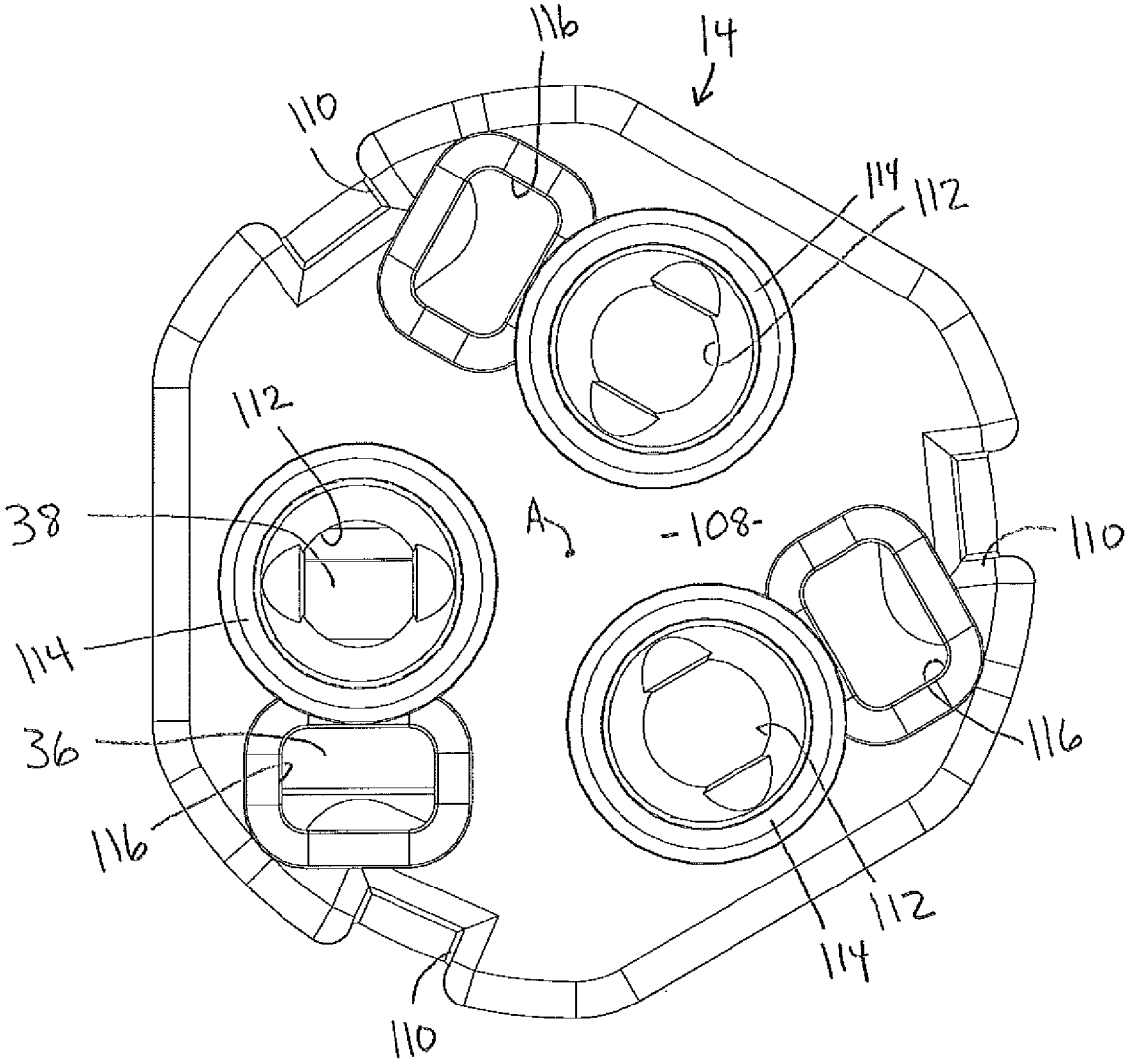
FIG. 25 is a rear elevation view of the male cap, with one male terminal shown therein.
Figure 26:
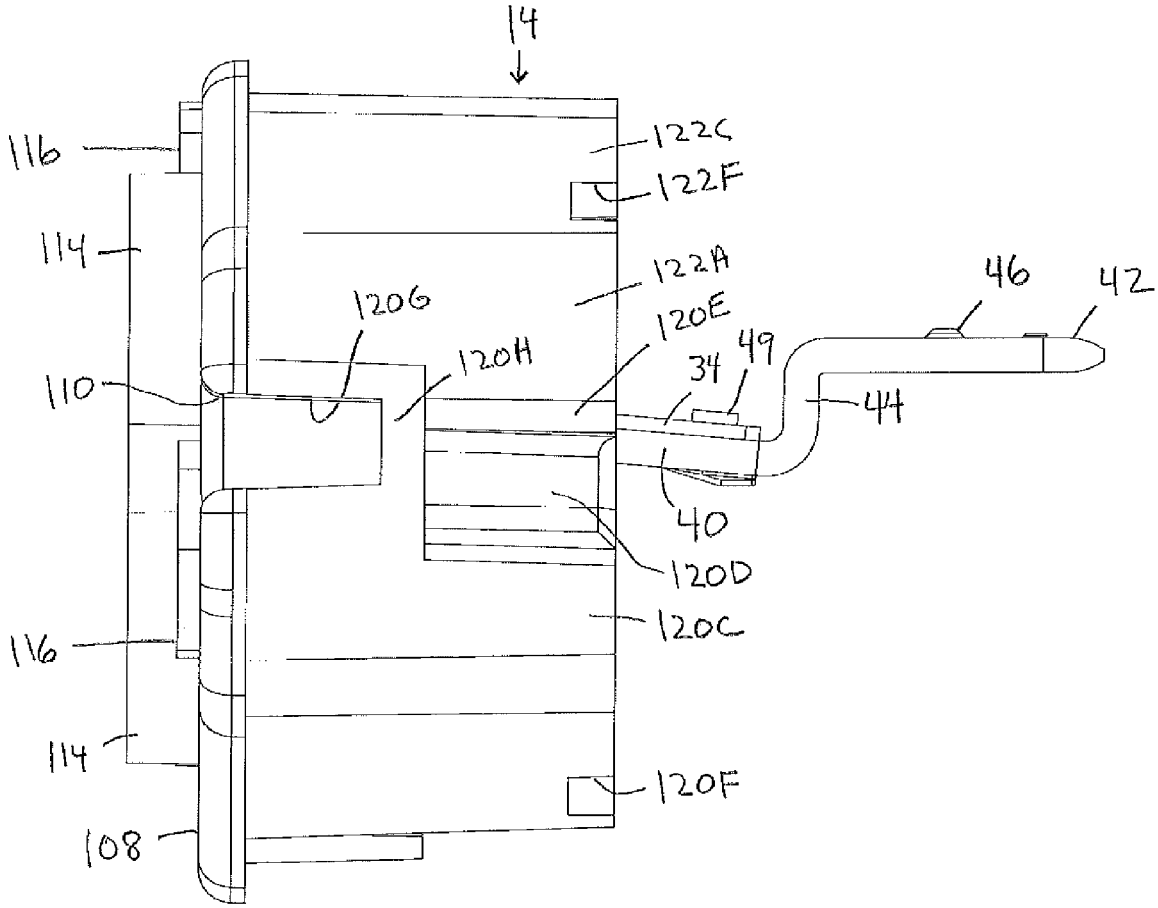
FIG. 26 is a side elevation view of the male cap, with one male terminal shown therein.
Figure 27:
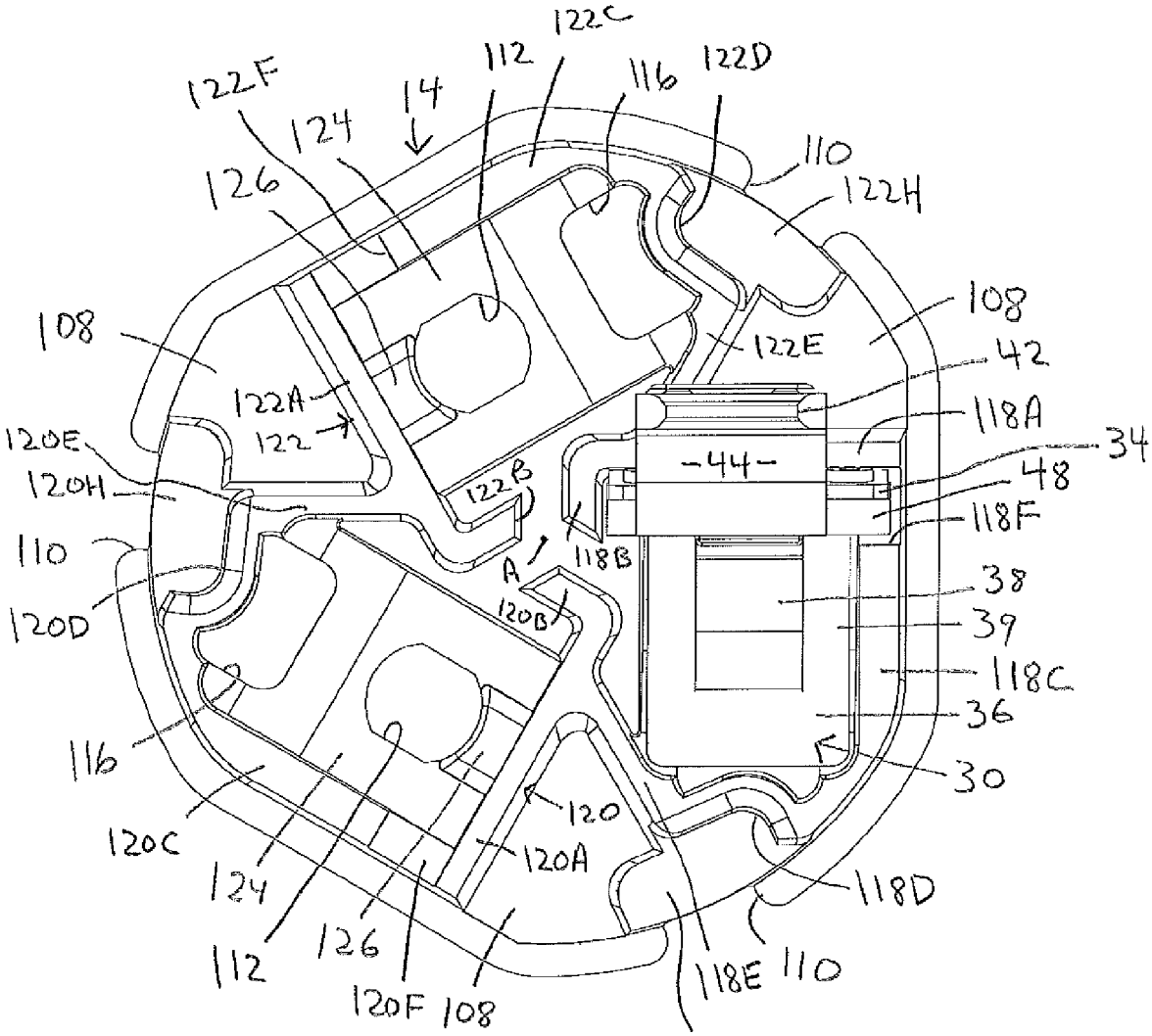
FIG. 27 is a front elevation view of the male cap, with one male terminal shown therein.
Figure 28:
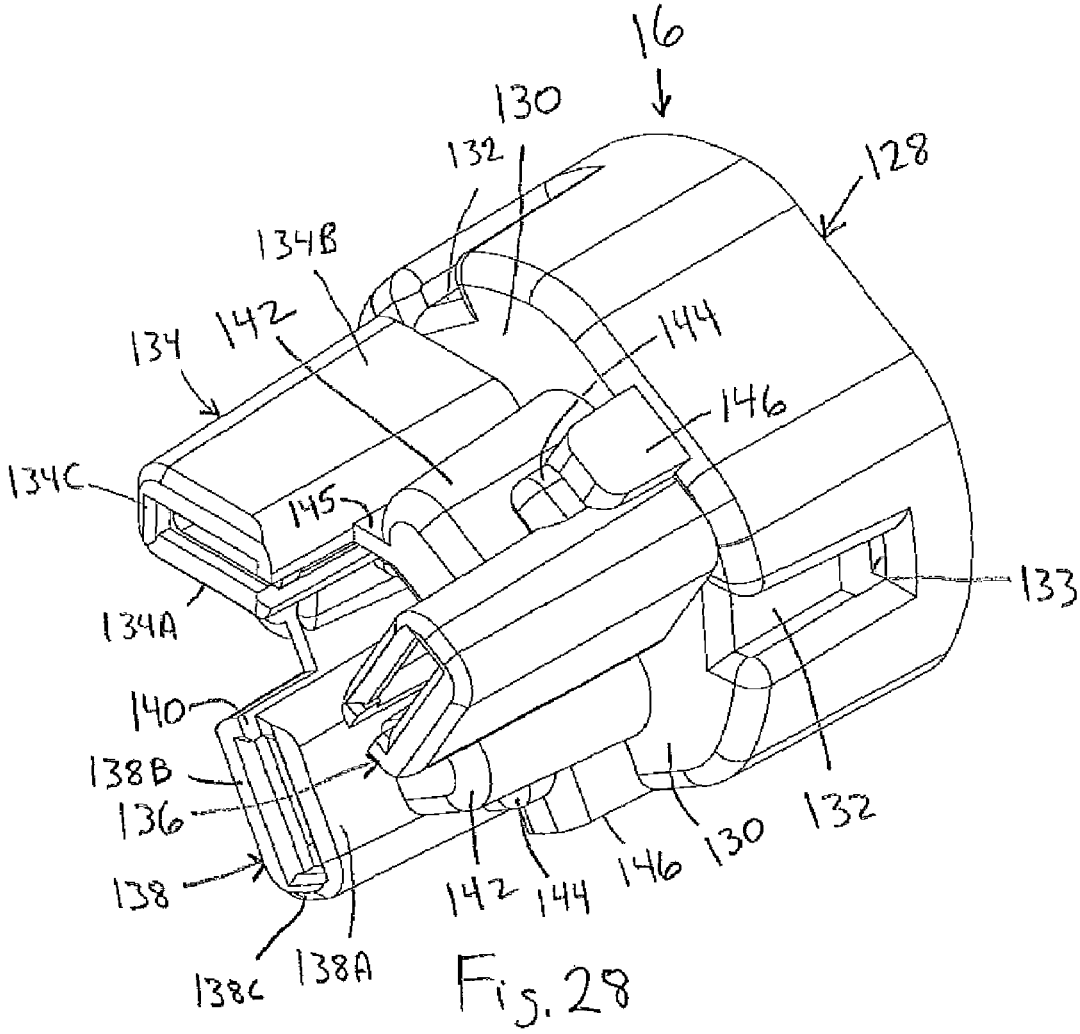
FIG. 28 is an isometric view of the female housing.

The curved walls 70B each have elongated indentations extending from the cross wall 72 partially to the rear edge of the shell. The indentations are defined by indented walls 74, which in the end views of FIGS. 21 and 23 are U-shaped. The indented walls do not extend the full length of the indentations, thus leaving openings 76 (FIG. 22).

The male housing 12 further includes three extension sections 78, 80 and 82 joined to the shell 70. Each of the extension sections has three walls including an outer portion, a long leg and a short leg, forming a generally U-shaped cross-section, as seen in FIG. 23. The constituent walls of the extension sections will be given letter designations, together with their respective reference numerals. Thus, outer portions are 78A, 80A and 82A, the long legs are 78B, 80B, 82B, and the short legs are 78C, 80C and 82C. Cutouts 84 are formed in the end of each outer portions 78A, 80A and 82A.

Continuing with FIG. 23, internal features of the extension sections include a central trefoil wall 86, which extends the full length of the extension sections. Together with the three extension sections, the trefoil wall defines three compartments for receiving the male blades, one of which is shown at 42. The blades extend through passages 88 in the cross wall 72. Adjacent each passage 88 there is a ledge 90 that extends a short distance from the cross wall to support the male blades 42. The ledge surrounds the passage 88 on three sides and joins the closed end of a wire receptacle box 92. The open side of the receptacle box 92 is seen in FIG. 21, with the interior end wall or seat shown at 93. These boxes define a hollow chamber which communicates with the interior of the shell to receive the end of a conductor inserted into the housing. The chamber constrains a conductor to a confined area. This is particularly important with stranded conductors because it prevents the conductors from flattening out or splaying, which if it occurred could cause a reduction in the holding force of the push-in connection elements. A rib 94 extends from the receptacle box 92 the full length of the extension sections. A shorter fillet 96 joins the receptacle box to an adjacent extension short leg, e.g., 78C.

The extension walls, e.g., 78A, 78B, 78C and trefoil wall 86 generally surround the fall length of the blades so that, when the enclosures are separated, objects are prevented from coming into contact with the blades and shorting them. An alternate embodiment of the male housing would have a latch on the external surface engageable with a mating latch on the female housing. These latches would be arranged such that they have a low engagement force and a very high disconnect force. This would prevent the unintentional disengagement of the enclosures.

Figure 20:
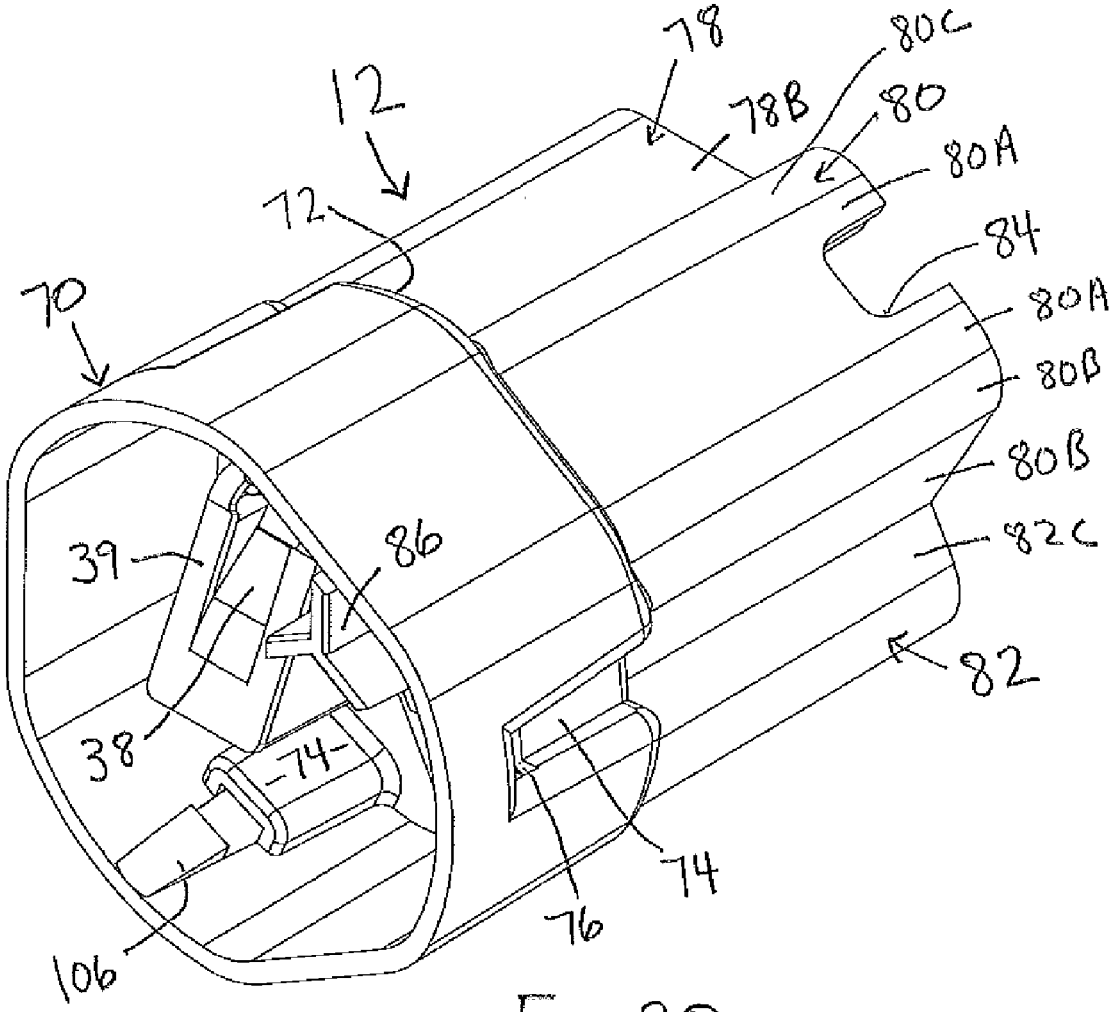
FIG. 20 is an isometric view of the male housing, with one of three male terminals shown therein, the other two male terminals being removed for clarity.

Internal features of the shell 70 are shown in FIGS. 20 and 21. There are three U-shaped spring supports 98 extending toward the rear of the shell from the cross wall 72. The top land of the supports is angled to accommodate the angle of the spring leg 36. A rib 100 in the middle of the spring supports 98 limits deflection of the spring finger 38. That is, it is desired that the disconnect of this invention be usable with wires ranging in size from 12 AWG to 18 AWG. With the larger wire sizes it may be possible to cause plastic deformation of the spring fingers during insertion of the wire. The rib 100 is disposed in the path of spring finger movement to limit flexure of the spring fingers to an amount no more than their elastic limit. A central shell trefoil wall 102 joins the spring supports and extends slightly above the supports but not all the way to the open end of the shell. One wall 92A of the wire receptacle box extends somewhat into the passageway 88, as seen in FIG. 21. A pair of notches 104 in the cross wall 72 bound this wall 92A at the base of the supports 98. These notches receive the wings 48 of the male terminals to fix the position of the terminals. Finally, three wedge-shaped latches 106 extend from the rear edge of the shell toward the openings 76. These latches engage straps on the outer surface of the male cap 14 to retain the cap in the housing.

Turning now to the male cap 14, details of this component are seen in FIGS. 24-27. The cap includes a transverse end wall 108 shaped similarly to the shell 70 in that it has three flat outer edges joined by three curved edges. The curved edges each have a cutout portion 110. Three wire ports 112 extend through the end wall. On the rear or external face of the end wall the ports are surrounded by upstanding cylindrical wire entry guides 114. Adjacent each port 112 is a test probe aperture 116 that provides access to the male terminal. The inner or front face of the end wall carries three longitudinal chambers 118, 120 and 122. Looking at one of the chambers in FIG. 27, chamber 118 is formed by a complex set of walls including: a long radial wall 118A having a tab 118B; a circumferential wall 118C that is joined to radial wall 118A and a portion of which terminates at a concave curved wall 118D; and a short radial wall 118E that joins with the next chamber. The chamber 118 also has a notch 118F at the junction of the long radial wall 118A and the circumferential wall 118C. The portion of the circumferential wall that is between the curved wall 118D and the end wall 108 has a groove 118G therein that defines a strap 118H. The groove receives the latch 106 of the male housing to lock the latch against the strap 118H. The chambers 120 and 122 have a similar structure. It will be noted that the three tabs 118B, 120B and 122B form a receptacle that receives the trefoil wall 102 of the shell 70 when the cap is placed in the housing.

Figure 36:
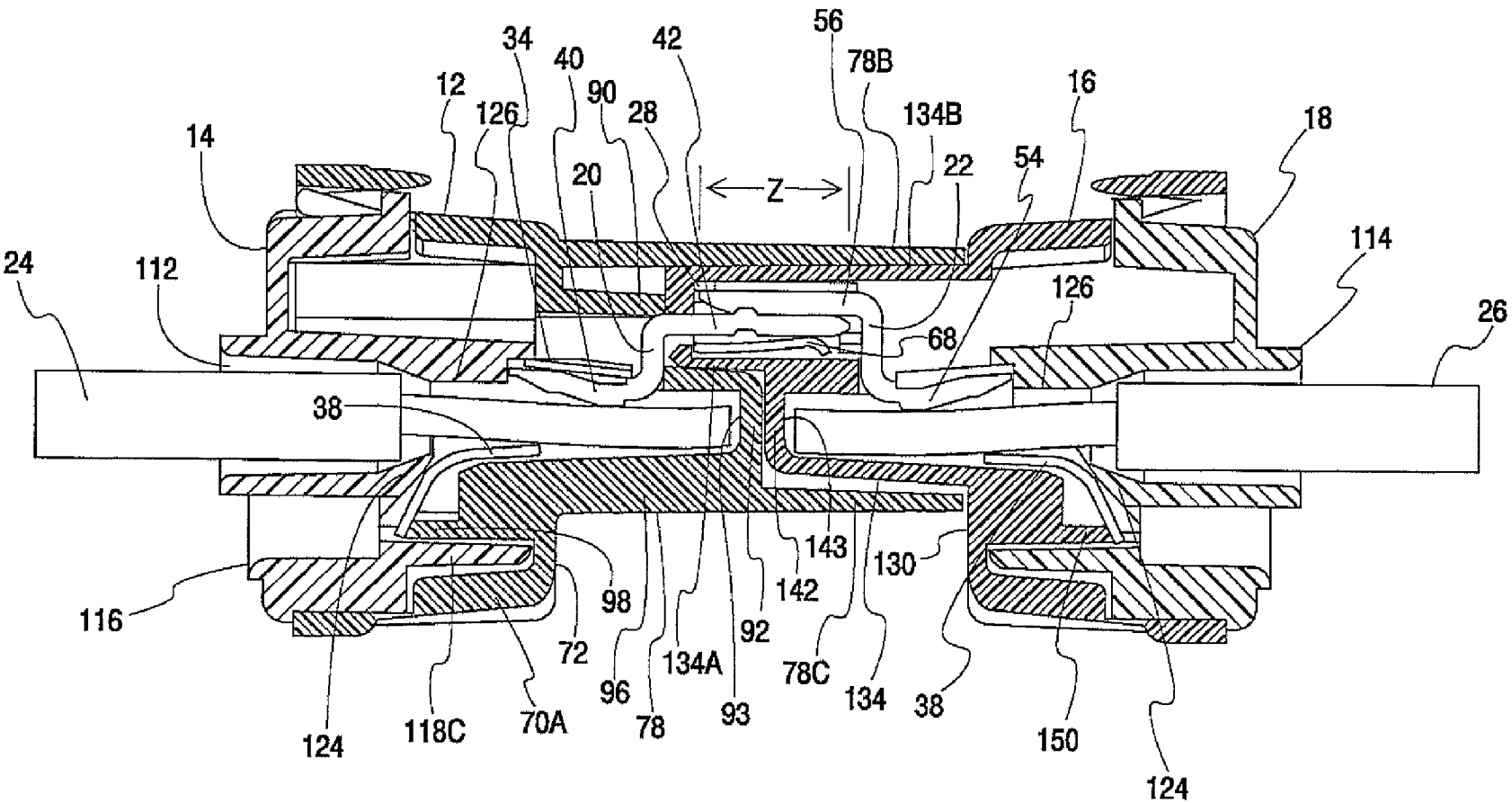
FIG. 36 is a section through an assembled disconnect, taken generally through mating male and female terminals, and diagrammatically showing two wires inserted therein.

Inside each chamber there is a spring support block 124 that extends from the end wall for a portion of the length of the chambers. It has an angled top surface to accommodate the angled spring leg 36. The wire ports 112 extend through the support block. The ports are tapered to guide a wire as it is inserted through the port, as best seen in FIG. 36. Adjacent the port 112 there is a wire guide block 126 which extends beyond the support block. The spring tangs 39 straddle the wire guide block. One of the wings 48 fits into the notch, e.g., 118F. The other wing is bounded by the tabs, such as 118B. The spring leg 36 rests on the spring support block 124 and a portion of it is aligned with the test probe aperture 116.

Figure 29:
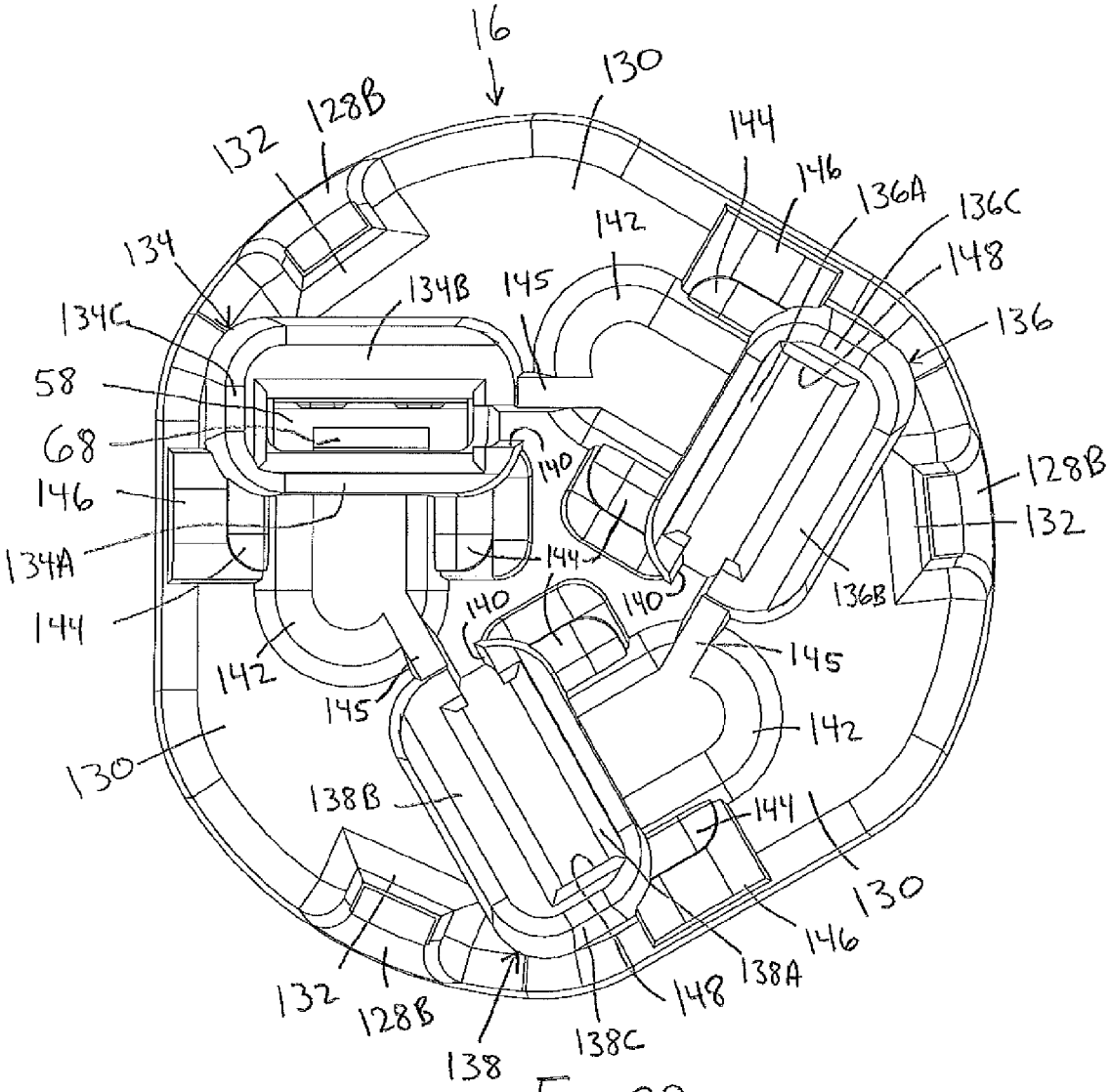
FIG. 29 is a front elevation view of the female housing, with one of thee female terminals shown therein, the other two female terminals being removed for clarity.
Figure 30:
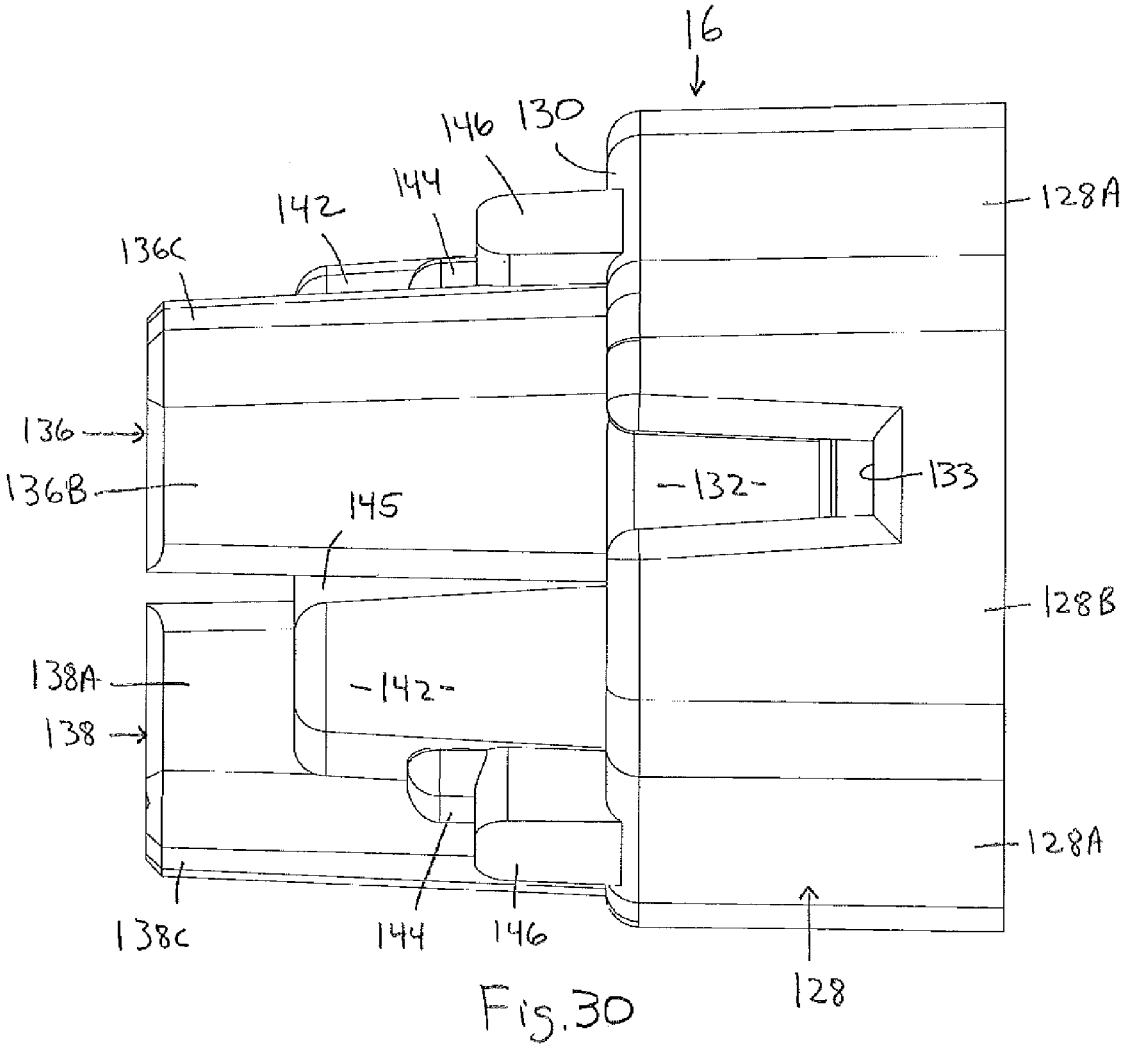
FIG. 30 is a side elevation view of the female housing.
Figure 31:
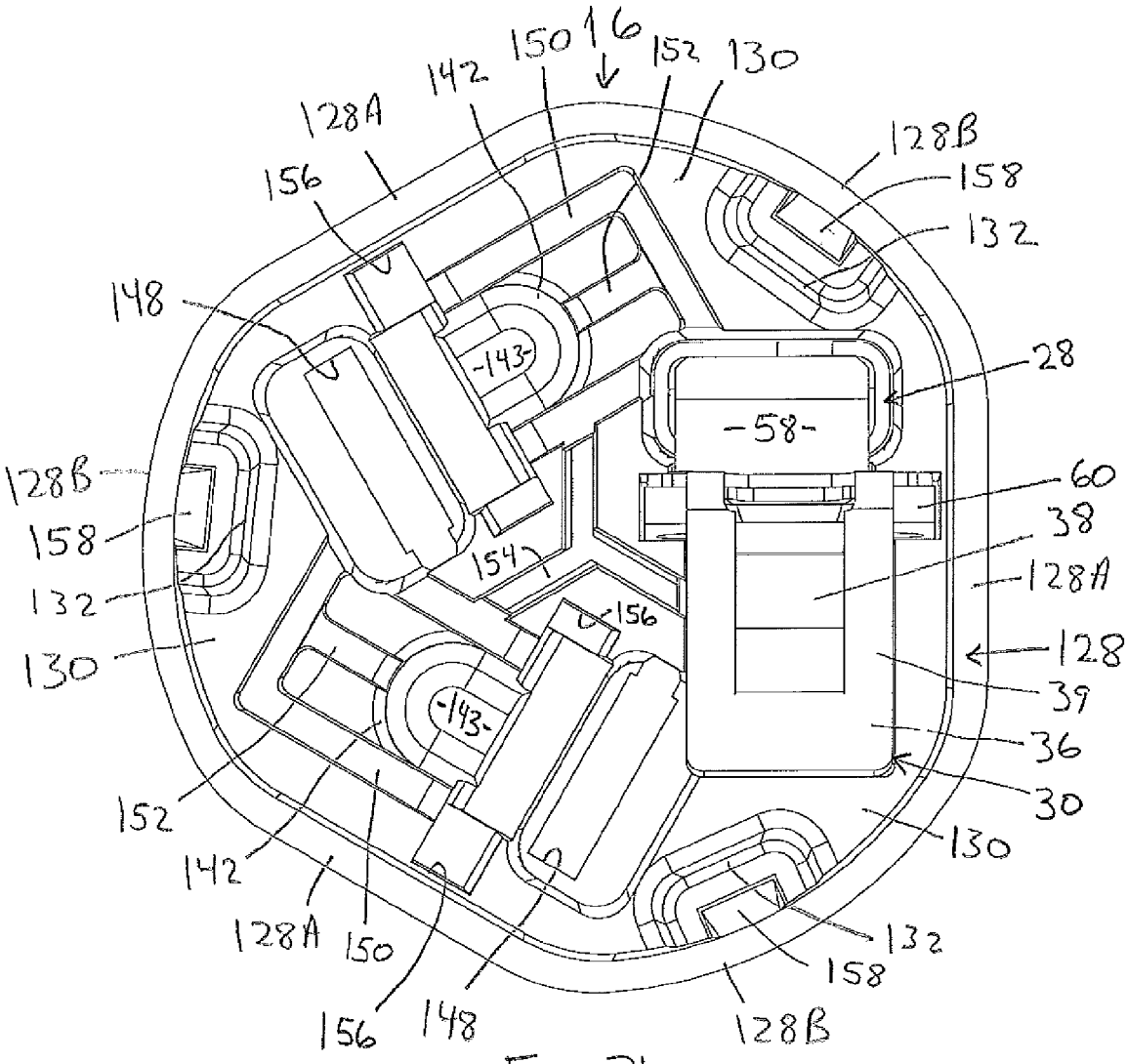
FIG. 31 is a rear elevation view of the female housing, with one female terminal shown therein.
Figure 32:
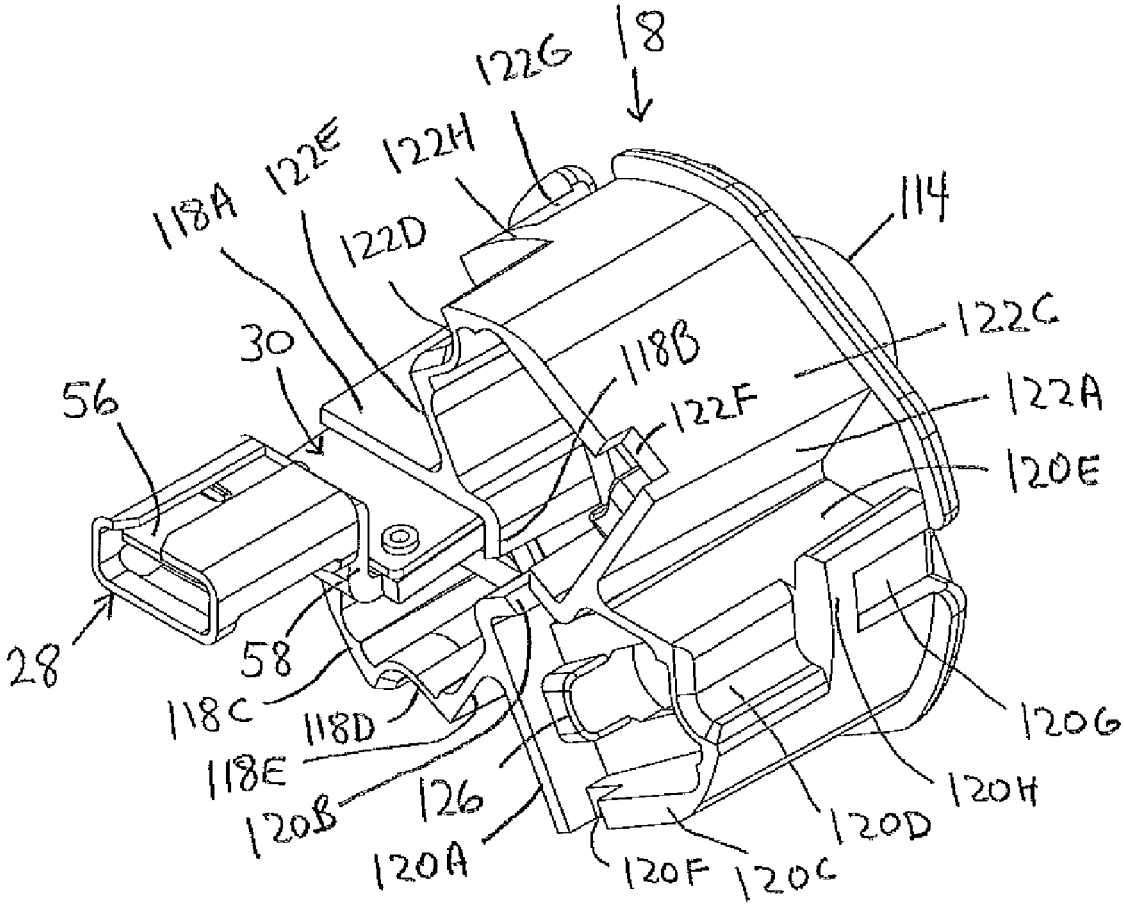
FIG. 32 is an isometric view of the female cap, with one female terminal shown therein.
Figure 33:
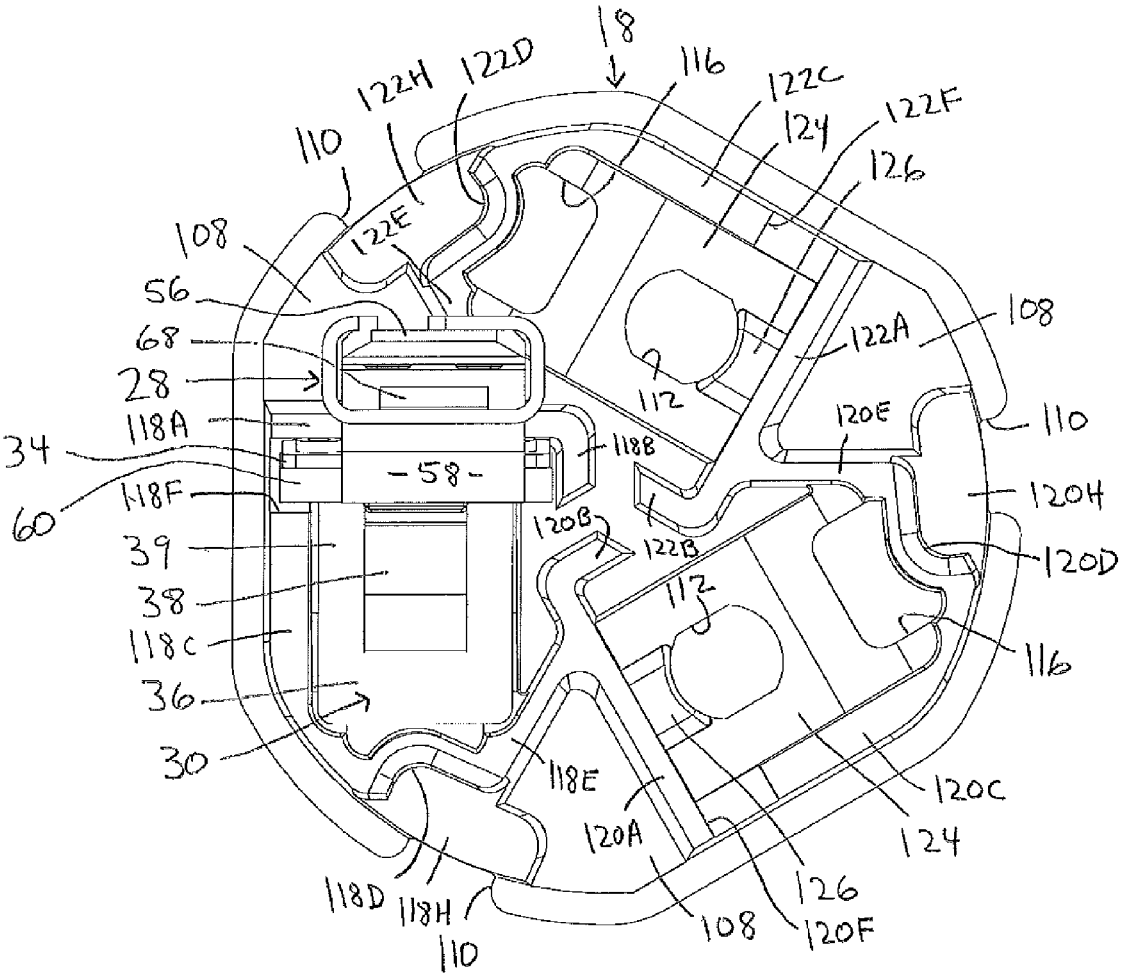
FIG. 33 is a front elevation view of the female cap, with one female terminal shown therein.
Figure 34:
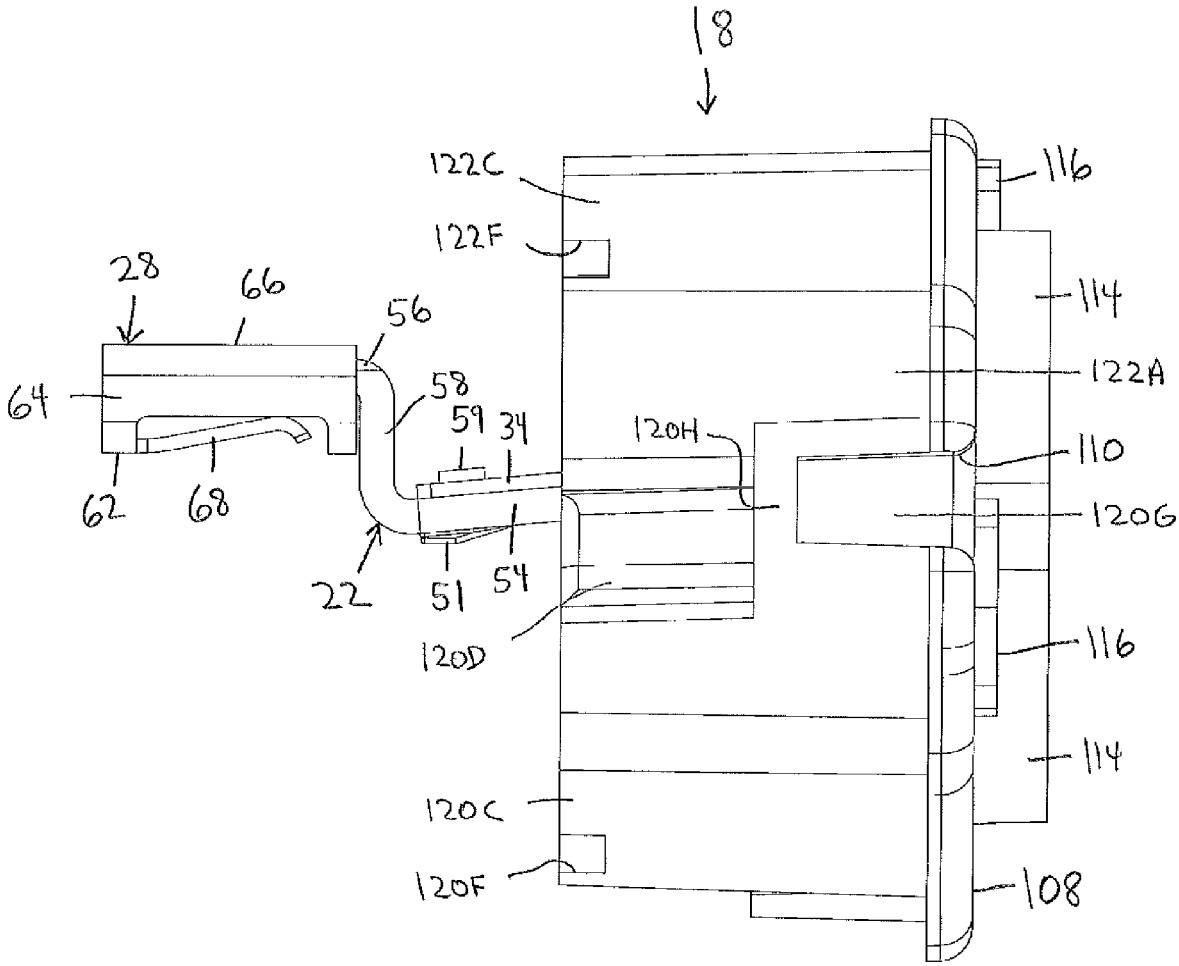
FIG. 34 is a side elevation view of the female cap, with one female terminal shown therein.
Figure 35:
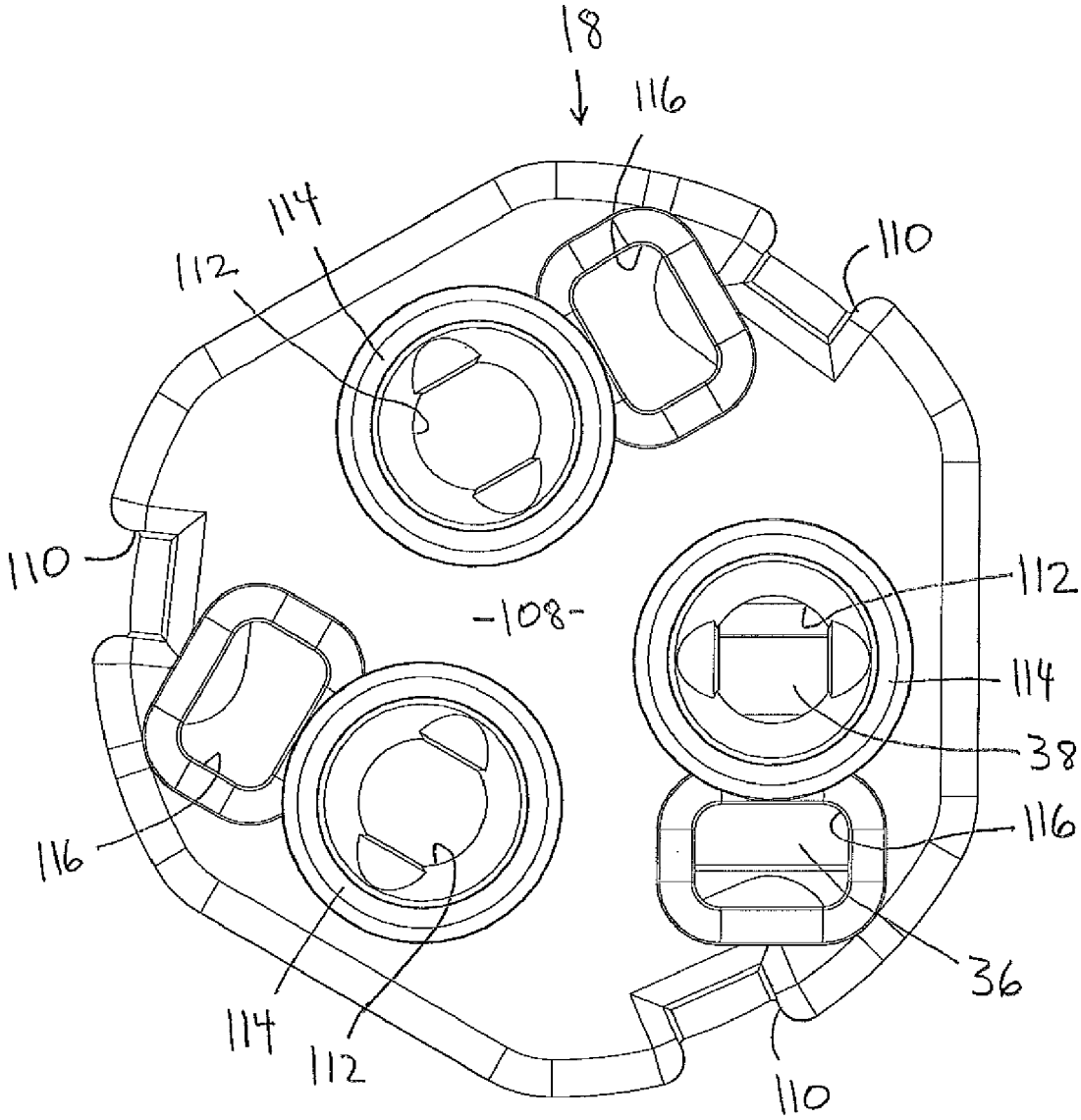
FIG. 35 is a rear elevation view of the female cap, with one female terminal shown therein.

The female housing 16 is shown in FIGS. 28-31. Like the male housing, the female housing has a shell 128 including three flat outer walls 128A joined by three curved walls 128B. These are joined by a transverse cross wall 130 which completes the shell. The curved walls 128B each have elongated indentations extending from the cross wall 130 partially to the rear edge of the shell. The indentations are defined by indented walls 132, which in the end views of FIGS. 29 and 31 are U-shaped. The indented walls do not extend the full length of the indentations, thus leaving openings 133 (FIG. 30).

The female housing 14 further includes three extension sections 134, 136 and 138 joined to the shell's cross wall 130. Each of the extension sections has three walls including inner, outer and end walls, forming a generally rectangular cross-section with the ends open, as seen in FIG. 29. The extension section constituent walls carry letter designations, together with their respective reference numerals. Thus, inner walls are 134A, 136A and 138A, the outer walls are 134B, 136B and 138B, and the end walls are 134C, 136C and 138C. It will be noted the inside ends of the inner and outer walls do not meet, leaving a slot 140 in the extensions. Continuing with FIGS. 28 and 29, wire receptacle boxes 142 are adjacent the inner wall of each extension. The interior of the receptacle box is seen in FIG. 31, with the end wall or seat shown at 143. This box receives the end of a conductor inserted into the housing. A rib 145 extends from the receptacle box 142 to the next extension section. Two-tiered notch boxes 144 are on either side of the receptacle boxes 142. The outermost of the notch boxes forms lugs 146. The lugs mate with the cutouts 84 of the male housing when the two enclosures are joined, as can be seen in FIGS. 1 and 2. The female blades extend through passages 148 in the cross wall 130 and into the extension sections. A terminal holder 28 is also disposed near the outer end of each extension section, with the female blade disposed in the interior of the terminal holder. The extension walls generally surround the full length of the female blades and the terminal holder so that, when the enclosures are disconnected, objects are prevented from coming into contact with the blades and shorting them.

Internal features of the shell 128 are shown in FIG. 31. These features are quite similar to those of the male housing. There are three U-shaped spring supports 150 extending toward the rear of the shell from the cross wall 130. The top land of the supports is angled to accommodate the angle of the spring leg 36. A rib 152 in the middle of the spring supports 148 limits deflection of the spring finger 38. A central shell trefoil wall 154 joins the spring supports and extends slightly above the supports but not all the way to the open end of the shell. A notch 156 is formed in the interior of each notch box 144. These notches receive the wings 60 of the female terminals to fix the position of the terminals. Three wedge-shaped latches 158 (FIG. 31) extend from the rear edge of the shell toward the openings 133. These latches engage straps on the outer surface of the female cap 18 to retain the cap in the housing.

Turning now to the female cap 18, details of this component are seen in FIGS. 32-35. The female cap itself is a mirror image of the male cap 14 so its description will not be repeated. Like parts are given like reference numerals from the description of the male cap. It is noteworthy that the fulcrum 58 of the female blade is somewhat longer than that of the male blade. This is because the female blade fits to the outside of the male blade and thus needs to be spaced farther from the wire than the male blade. As noted above, a possible alternative is to arrange the connector components such that the male and female blades are identical.

It will be noted that the walls of the extensions in both housing are disposed between any two terminal blades to prevent direct access between adjacent blades. In other words, any imaginary line transverse to the axis of the housing that intersects two contacts passes through at least one compartment wall. There is no direct path from one contact to the adjacent contact due to the intervening presence of the compartment walls. This is true whether the housings are engaged or disengaged with one another. The compartment walls are also arranged to prevent direct access to the terminals from an external point such that it is not possible to short to any external contacts making the connector safe to touch. This provides an extra measure of protection against shorting of the contacts, regardless of which housing is connected to the power supply or the load.

FIG. 36 illustrates how the assembled components of each enclosure cooperate. In particular, in the male housing 12 it can be seen that the spring foot 34 and contact portion 40 adjoin the top of the wire guide block 126. The spring leg 36 is held between the sloping spring support block 124 and the spring support 98 of the male housing. The circumferential wall 118C of the cap chamber fits between the housing spring support 98 and the flat outer wall 70A of the housing shell 70.

FIG. 36 also illustrates how the assembled enclosures cooperate when joined. The extension 134 of the female housing fits within extension 78 of the male housing. The ends of the extension walls of the male housing abut the cross wall 130 of the female housing. Also, the female wire receptacle box 142 fits within the male extension 78. It will also be noted that the receptacle box 92 in the male housing is aligned with the receptacle box 142 of the female housing. This places the ends of the conductors 24, 26 immediately adjacent one another, each inside its own receptacle box. This allows a shorter length for the housing, with consequent material and space savings.

The use, operation and function of the disconnect are as follows. Connection of a wire to an enclosure is straightforward. A stripped end of a wire 24, 26 is inserted into a wire port 112 of the cap 14 or 18. As the conductor enters the interior of the housing 12 or 16 it encounters one of the spring fingers 38 and causes it to flex sideways to permit the conductor to pass. The flexing of the spring finger causes it to exert pressure on the conductor. Due to the angle of the spring finger, any tendency to remove the conductor causes the spring finger to dig into the conductor and hold it in the housing. The pressure of the spring finger 38 causes solid electrical engagement between the conductor and the contact portions 40, 54 of the terminals.

Connection of the two housings 12, 16 is as follows. The two housings are placed in facing relation, with their axes aligned, as shown in FIG. 36. In this regard, it should be noted that it would be possible to add a keying feature to insure the correct circuits are aligned with one another. The extensions 78, 80, 82 of the male housing 12 are facing the extensions 134, 136, 138 of the female housing 16. The user then pushes the two housings together. The extensions 134, 136, 138 will fit into the extensions 78, 80, 82. As they do so the male blades 42 will move through the end of the extensions 134, 136, 138 and into the terminal holder 28. As they do so the pressure plates 68 will engage the male blades and urge them into solid engagement with the female blades 56. As the bumps 57, 47 of the blades move past one another they provide a tactile feedback that the connector enclosures are fully engaged. Protrusion 46 in particular is certain to be pressed firmly against the female blade. This engagement allows relatively high current to be carried by the disconnect, something on the order of 20 amps.

FIG. 36 shows how the male and female blades 42 and 56 overlap one another when connected. The area where they overlap defines an engagement zone Z. It will be noted that the internal end walls or seats 93, 143 of the wire receptacle boxes 92 and 142 are within the engagement zone Z. In the preferred arrangement shown the receptacle boxes are immediately adjacent one another, although alternately they could be separated somewhat. Putting the receptacle boxes next to each other in the connected housings allows the length of the disconnect to be made as small as possible. This not only saves material, and therefore cost, in the manufacture of the disconnect, it also permits the disconnect to be used in tight quarters where conventional disconnects would not fit. It is also noted that the connected housings have their wire receptacle boxes axially aligned with one another. This saves space and allows multiple sets of wires to be connected in a very compact disconnect.

When it is desired to separate the disconnect, a user can simply pull the two housings apart. The male blade will retract from the terminal holder. It should be noted that the male and female busbars 32, 52 may be made of tin-plated copper for superior conducting capacity. The conductivity of the busbars need not be compromised to enhance their mechanical properties since the necessary mechanical functions are performed by the springs 30 and the terminal holders 28. Similarly, these mechanical parts can be made of stainless steel since they need not provide electrical conductivity. Furthermore, the male and female blades can have the relatively simple, flat construction shown because the terminal holder is responsible for maintaining them in contact with one another.

Another aspect of the present invention is the arrangement of the terminals in a manner that minimizes the outer dimensions of the enclosures in a plane transverse to the longitudinal axis. In the enclosures illustrated this dimension is largely a radial dimension, but the description of the transverse dimensions as 'radial' is not meant to imply that the outer walls of the housings must have a generally cylindrical cross-section. In connectors having three terminals, placement of the terminals in a generally radial configuration with respect to one another affords a more compact housing. That is, the radial dimension of the housing can be reduced if the terminals are arranged such that planes of the blades are arcuately spaced from one another by substantially 120°, as seen in a plane transverse to the longitudinal axis. This arcuate spacing of the terminal blades is most clearly shown in the front and rear elevations of FIGS. 21, 23, 29 and 31.

While the preferred form of the invention has been shown and described herein, it should be realized that there may be many modifications, substitutions and alterations thereto. For example, while the housing shown accommodates connections of three wire pairs, other numbers of compartments and contacts could be used to connect different numbers of wire pairs. It is preferred that the terminal holder be mounted in the housing with the female blade such that the female blade and the terminal holder receive a male blade from the other housing. But it would be possible to arrange the terminal holder to be attached to the male blade for movement to the female blade. Obviously the housing extensions would have to be modified to accommodate such an arrangement. A further possible alternative construction of the terminal holder could be to have it engageable with just one of the terminals to bias it toward the other terminal when the enclosures are engaged. In this case the terminal not engaged by the terminal holder would have to be restrained by the housing to resist pressure from the terminal holder, thereby allowing the terminals to be tightly held together. Another alternative arrangement would allow for one of the circuits to engage first before any of the other circuits. This would further enhance the hot mating capability. An additional possible alternative is to arrange the wire ports and terminals to accommodate multiple wires connecting to a single pole or terminal. That is, multiple springs could be connected to a single busbar, which would permit daisy chaining from one connector to another.

Other alternatives for the terminal holder include the channel as shown but with a pressure plate in both the top and bottom of the channel. Or the terminal holder could have a generally U-shaped enclosure in which the bight of the enclosure lies to one side of the axis of the terminals and the two legs pinch the terminals between them.

I claim:

1. An electrical disconnect, comprising:

first and second enclosures defining a longitudinal axis along which the enclosures are movable to engage and disengage one another;

a first electrical terminal disposed entirely within the first enclosure and a second electrical terminal disposed entirely within the second enclosure, the first and second terminals each including a busbar having a contact portion and a blade, the contact portion being electrically engageable with at least one electrical conductor of an inserted wire, and the blade having opposed mating and non-mating surfaces that comprise planar portions; and a terminal holder disposed entirely within one of the enclosures, the terminal holder being engageable with the non-mating surfaces of the blades to bias the mating surfaces of the blades into overlapping engagement with one another when the enclosures are moved to engage one another.

2. The electrical disconnect of claim 1 wherein the blades are generally planar.

3. The electrical disconnect of claim 2 wherein the terminal holder comprises a channel having a pressure plate positioned therein for engagement with at least one of the blades.

4. The electrical disconnect of claim 3 wherein the channel has a generally rectangular cross-section.

5. The electrical disconnect of claim 1 wherein the terminal holder comprises a pressure plate which is engageable with at least one of the blades.

6. The electrical disconnect of claim 1 wherein the first and second enclosures each further comprise an extension with each extension surrounding one of the terminals, the extension of one enclosure being configured to fit into the extension of the other enclosure when the enclosures are engaged.

7. The electrical disconnect of claim 1 wherein the busbars of the first and second electrical terminals are made of a first material selected for its electrical conductivity and the terminal holder is made of a second material selected for its resilience.

8. The electrical disconnect of claim 1 wherein at least one of the terminals further comprises a spring connected to the busbar, the spring being arranged to secure a conductor of a wire pushed into the enclosure in engagement with the contact portion.

9. An electrical disconnect, comprising:

first and second enclosures defining a longitudinal axis along which the enclosures are movable to engage and disengage one another;

at least one electrical terminal disposed entirely within each of the first and second enclosures, the first and second terminals each including a spring and a busbar, the busbar having a contact portion and a blade having at least one planar portion, the spring being arranged to secure a conductor of a wire pushed into the enclosure in engagement with the contact portion; and at least one terminal holder disposed entirely within one of the enclosures, the terminal holder being engageable with the blades to bias the blades into engagement with one another when the enclosures are engaged.

10. The electrical disconnect of claim 9 wherein the first and second enclosures each further comprise a plurality of extensions with each extension surrounding one of the terminals, the extensions of one enclosure being configured to fit into the counterpart extensions of the other enclosure when the enclosures are engaged.

11. The electrical disconnect of claim 9 wherein said at least one terminal holder comprises a pressure plate which is engageable with at least one of the blades.

12. In an electrical disconnect having first and second enclosures defining a longitudinal axis along which the enclosures are movable to engage and disengage one another, at least one first electrical terminal disposed entirely within the first enclosure and at least one second electrical terminal disposed entirely within the second enclosure, the first and second terminals each including a busbar having a contact portion and a blade having at least one planar portion, the contact portion being engageable with at least one electrical conductor of an inserted wire, the improvement comprising:

at least one terminal holder entirely within one of the enclosures, the terminal holder defining a socket for receiving the blades of the first and second electrical terminals when the enclosures are engaged, the terminal holder including a resilient member engageable with at least one of the blades when the blades are in the socket to bias the blades into engagement with one another, the biasing force of the resilient member on the blades being counteracted solely by the terminal holder.

13. The electrical disconnect of claim 12 wherein the terminal holder has a top wall, at least one bottom flange, and at least one side wall joining the top wall and bottom flange, the top wall, bottom flange and side wall defining the socket, the resilient member being formed in one of the top wall and bottom flange and the other of the top wall and bottom flange counteracting the biasing force of the resilient member.

14. The electrical disconnect of claim 13 wherein the resilient member is a pressure plate.

15. The electrical disconnect of claim 12 wherein the resilient member is a pressure plate.

16. The electrical disconnect of claim 15 wherein the pressure plate has a free edge that is curved away from the surface of the pressure plate that engages the at least one of the blades.

17. The electrical disconnect of claim 12 wherein the busbar is made of a first material selected for its electrical conductivity and the resilient member is made of a second material selected for its resilience.

18. The electrical disconnect of claim 12 wherein at least one of the first and second terminals further comprises a spring arranged to secure the at least one electrical conductor of an inserted wire pushed into the enclosure in engagement with the contact portion.

19. The electrical disconnect of claim 12 wherein the terminal holder has a top wall, two sides walls, and two bottom flanges, each bottom flange joined to one of the side walls; the top wall, bottom flanges and side walls defining the socket, the resilient member being formed in one of the top wall and bottom flanges and the other of the top wall and bottom flanges counteracting the biasing force of the resilient member.

20. The electrical disconnect of claim 19 wherein the resilient member is a pressure plate formed in the top wall.

* * * * *